US008982025B2

(12) United States Patent
Chen

(10) Patent No.: US 8,982,025 B2
(45) Date of Patent: Mar. 17, 2015

(54) DEVICE AND A METHOD FOR DRIVING LIQUID CRYSTAL DISPLAY

(75) Inventor: Ming Chen, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 851 days.

(21) Appl. No.: 12/421,942

(22) Filed: Apr. 10, 2009

(65) Prior Publication Data

US 2009/0256793 A1 Oct. 15, 2009

(30) Foreign Application Priority Data

Apr. 10, 2008 (CN) ..... 2008 1 0103786

(51) Int. Cl.
*G09G 3/36* (2006.01)

(52) U.S. Cl.
CPC ..... *G09G 3/3688* (2013.01); *G09G 2320/0276* (2013.01); *G09G 2320/0666* (2013.01); *G09G 2320/0673* (2013.01)
USPC ..... 345/89

(58) Field of Classification Search
USPC ..... 345/87–98
See application file for complete search history.

(56) References Cited

U.S. PATENT DOCUMENTS

2006/0214895 A1* 9/2006 Shih et al. ..... 345/88
2008/0030444 A1* 2/2008 Hsueh ..... 345/87

FOREIGN PATENT DOCUMENTS

CN 101044544 A 9/2007
JP 06-348235 A 12/1994
JP 2005-202057 A 7/2005
JP 2006-058603 A 3/2006
JP 2007-010871 A 1/2007
JP 2007-078797 A 3/2007
JP 2008-003518 A 1/2008
KR 2004-18932 A 3/2004

OTHER PUBLICATIONS

Chinese Rejection Decision dated Jul. 30, 2014, Appln. No. 200810103786.4.
Sixth Chinese Office Action dated Mar. 21, 2014; Appln. No. 200810103786.4.
Fifth Chinese Office Action dated Dec. 18, 2013; Appln. No. 200810103786.4.

* cited by examiner

*Primary Examiner* — Dennis Joseph
(74) *Attorney, Agent, or Firm* — Ladas & Parry LLP

(57) ABSTRACT

The present invention relates to device for driving liquid crystal display (LCD) and method for driving the same. The device for driving LCD comprises a voltage input module for receiving Gamma reference voltage; a voltage generation module connected to said voltage input module, for generating pixel driving voltage of a corresponding color with one resistor-chain, according to the Gamma reference voltage and the color of pixel being driven; and a voltage output module connected to said voltage generation module, for transmitting the pixel driving voltage of said corresponding color to a liquid crystal panel. According to an embodiment of the present invention, voltage generation units that respectively generate pixel driving voltage of three colors are set on one resistor-chain, and a corresponding voltage generation unit is selected by a multi-selector according to the color of pixel being driven, so that the corresponding voltage generation unit transmits the pixel driving voltage to the voltage output module. According to an embodiment of the present invention, color shifting phenomenon is effectively overcome, thus improving TFT-LCD's picture quality.

5 Claims, 5 Drawing Sheets

DEVICE AND A METHOD FOR DRIVING LIQUID CRYSTAL DISPLAY

FIELD OF THE INVENTION

The present invention relates to the field of liquid crystal display (LCD), a device and a method for driving liquid crystal display.

BACKGROUND OF THE INVENTION

Thin Film Transistor-Liquid Crystal Display (TFT-LCD) has the advantages of low weight, low power consumption, less radiation and the like. In nowadays life, TFT-LCD has gradually replaced the dominant position of the traditional Cathode Ray Tube (CRT) in the field of display. The basic principle for liquid crystal to display is that: because liquid crystal molecules in different arrangement states have different polarization effect with respect to the light, the transmissivity of light can be controlled via the liquid crystal molecule in different arrangement states, and different gray levels of red, blue and green lights can be generated through liquid crystal molecule's such property, making LCD generate rich image.

With the development of TFT-LCD driving technology, users' requirements for picture quality are increasing, where color accuracy is one of important parameters to evaluate picture quality. The present research reveals that color shifting phenomenon is a common problem that affects the color accuracy of TFT-LCD picture. The main reason for causing color shifting phenomenon is that liquid crystal molecule has a different transmission property with respect to red, green and blue lights, and if the lights of these three colors use the same Gamma voltage, although the resulting synthesized gray level satisfies the target Gamma curve, Gamma curve for these three colors do not coincident with each other, and that is so-called color shifting phenomenon. FIG. 6 is a schematic diagram for illustrating generation of color shifting according to the prior art, where ordinate represents transmissivity, and abscissa represents gray level. As can be seen from FIG. 6, when using the same kind of Gamma voltage, for the same gray level, the respective transmissions for red light 11, blue light 12 and green light 13 are different from ideal values. When color shifting phenomenon is severe, the phenomenon that the picture is a little blue or red often occurs, degrading the picture quality greatly.

Prior art provides many solutions for such problem. One solution is Accurate Color Capture (ACC) solution, in which the levels for red, green and blue lights are adjusted so that the Gamma curves for these three colors are approximately identical. This solution mitigates the color shifting phenomenon to some extent, however, its adjusting accuracy is not high. Moreover, it requires to add new functional module in timing controller, thus increasing the complexity of manufacture process and also increasing the manufacture cost. Another solution uses three resistor-chains to adjust those three colors respectively. FIG. 7 is a structural diagram of the solution for employing three resistor-chains according to the prior art. This solution comprises three resistor-chains, that is, a first resistor chain 21, a second resistor chain 22, and a third resistor chain 23, each resistor-chain corresponds to the output of pixel driving voltage for one color. However, this solution needs to establish three resistor-chains inside the source driving IC. This not only makes design complex, but also increases the cost greatly.

SUMMARY OF THE INVENTION

Embodiments of the present invention provide a device and a method for driving LCD. The pixel driving voltages of three colors are generated with one resistor-chain, thus having the advantages of simple structure and low cost.

An embodiment of the present invention provides a device for driving LCD, comprising:

a voltage input module for receiving Gamma reference voltage;

a voltage generation module connected to said voltage input module, for generating pixel driving voltage of a corresponding color with one resistor-chain, according to the Gamma reference voltage and the color of pixel being driven;

a voltage output module connected to said voltage generation module, for transmitting the pixel driving voltage of said corresponding color to a liquid crystal panel.

said voltage generation module comprises:

one resistor-chain comprising a plurality of resistors in series, input terminal of which is connected to said voltage input module;

a red pixel voltage generation unit set on said resistor-chain, for generating red pixel driving voltage according to Gamma reference voltage;

a green pixel voltage generation unit set on said resistor-chain, for generating green pixel driving voltage according to Gamma reference voltage;

a blue pixel voltage generation unit set on said resistor-chain, for generating blue pixel driving voltage according to Gamma reference voltage;

a multi-selector, input terminal of which receives the color of pixel being driven, and output terminal of which is connected to said red pixel voltage generation unit, said green pixel voltage generation unit and said blue pixel voltage generation unit respectively, for selecting the corresponding red pixel voltage generation unit, green pixel voltage generation unit or blue pixel voltage generation unit according to the color of pixel being driven so that the corresponding voltage generation unit transmits, through said voltage output module, pixel driving voltage of the corresponding color to a liquid crystal panel.

said red pixel voltage generation unit comprises a plurality of red pixel voltage generation sub units each generating a red pixel driving voltage corresponding to Gamma reference voltage.

said green pixel voltage generation unit comprises a plurality of green pixel voltage generation sub units each generating a green pixel driving voltage corresponding to Gamma reference voltage.

said blue pixel voltage generation unit comprises a plurality of blue pixel voltage generation sub units each generating a blue pixel driving voltage corresponding to Gamma reference voltage.

An embodiment of the present invention also provides a method for driving LCD, comprising:

step 1: the voltage input module receives Gamma reference voltage;

step 2: the multi-selector receives the color of pixel being driven, and performs step 3 on red pixel, step 4 on green pixel, and step 5 on blue pixel according to the color of pixel being driven;

step 3: the multi-selector transmits control signal to the red pixel voltage generation unit that is set on the resistor-chain, so that the red pixel voltage generation unit generates red pixel driving voltage according to said Gamma reference voltage, and transmits said red pixel driving voltage to liquid crystal panel through the voltage output module;

step 4: the multi-selector transmits control signal to green pixel voltage generation unit that is set on the resistor-chain, so that the green pixel voltage generation unit generates green pixel driving voltage according to said Gamma reference voltage, and transmits said green pixel driving voltage to liquid crystal panel through the voltage output module;

step 5: the multi-selector transmits control signal to blue pixel voltage generation unit that is set on the resistor-chain, so that the blue pixel voltage generation unit generates blue pixel driving voltage according to said Gamma reference voltage, and transmits said blue pixel driving voltage to liquid crystal panel through the voltage output module.

An embodiment of the present invention provides a device and a method for driving LCD, in which voltage generation units that respectively generate pixel driving voltage of three colors are set on one resistor-chain, and a corresponding voltage generation unit is selected by multi-selector according to the color of pixel being driven, so that the corresponding voltage generation unit transmits the pixel driving voltage to voltage output module. As compared with Accurate Color Capture solution according to the prior art, the adjusting accuracy of the present invention is higher. As compared with three resistor-chains solution according to the prior art, the present design structure is simple and manufacture cost is lower. The device and method for driving LCD according to an embodiment of the present invention effectively overcomes color shifting phenomenon, thus improving TFT-LCD's picture quality.

The technical solution of the embodiments of the present invention will be further described in detail with reference to drawings and embodiments below.

DESCRIPTION OF THE PREFERRED EMBODIMENTS

Figure 1:
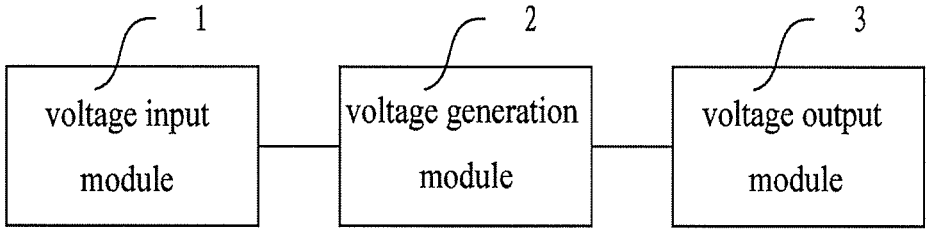
FIG. 1 is a structural schematic diagram of the device for driving LCD according to an embodiment of the present invention.

FIG. 1 is a structural schematic diagram of the device for driving LCD according to an embodiment of the present invention. As shown in FIG. 1, the device for driving LCD comprises a voltage input module 1 for receiving Gamma reference voltage; a voltage generation module 2 connected to voltage input module 1, for generating pixel driving voltage of a corresponding color with one resistor-chain, according to the Gamma reference voltage and the color of pixel being driven; and a voltage output module 3 connected to voltage generation module 2, for transmitting the pixel driving voltage of the corresponding color to a liquid crystal panel.

Figure 2:
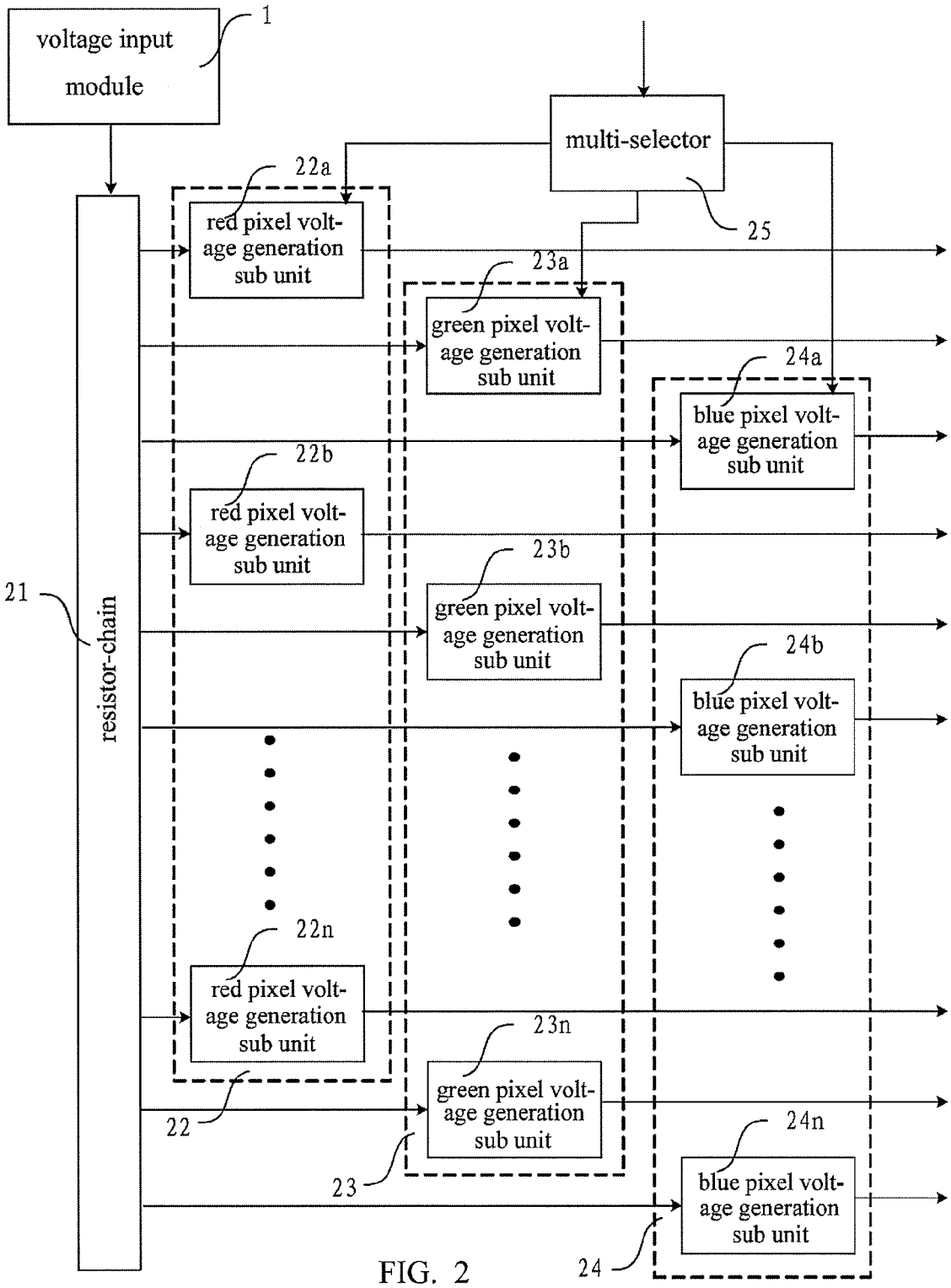
FIG. 2 is a structural schematic diagram of voltage generation module according to an embodiment of the present invention.

FIG. 2 is a structural schematic diagram of voltage generation module according to an embodiment of the present invention. As show in FIG. 2, the main structure of voltage generation module is a resistor-chain 21 comprising a plurality of resistors in series, input terminal of which is connected to the voltage input module 1; a red pixel voltage generation unit 22 for generating red pixel driving voltage according to Gamma reference voltage, a green pixel voltage generation unit 23 for generating green pixel driving voltage according to Gamma reference voltage, and a blue pixel voltage generation unit 24 for generating blue pixel driving voltage according to Gamma reference voltage, that are set on the resistor-chain 21 respectively; a multi-selector 25, input terminal of which receives the color of pixel being driven, and output terminal of which is connected to red pixel voltage generation unit 22, green pixel voltage generation unit 23 and blue pixel voltage generation unit 24 respectively, for selecting the corresponding red pixel voltage generation unit 22, green pixel voltage generation unit 23 and blue pixel voltage generation unit 24 according to Gamma reference voltage and the color of pixel being driven, so that the corresponding voltage generation unit transmits pixel driving voltage of the corresponding color to a liquid crystal panel through voltage output module.

In particular, each pixel voltage generation unit comprises a plurality of pixel voltage generation sub units that are set on resistor-chain 21. For example, red pixel voltage generation unit 22 comprises a plurality of red pixel voltage generation sub units that are set on resistor-chain 21, that is, red pixel voltage generation sub unit 22*a*, red pixel voltage generation sub unit 22*b*, . . . , red pixel voltage generation sub unit 22*n*, each of which generates a red pixel driving voltage corresponding to Gamma reference voltage according to its set position (that is, the resistance on the resistor-chain) so as to drive the red pixel on the liquid crystal panel. In the same way, green pixel voltage generation unit 23 comprises green pixel voltage generation sub units 23*a*, 23*b*, . . . , 23*n*, each of which generates a green pixel driving voltage corresponding to Gamma reference voltage according to its set position so as to drive the green pixel on the liquid crystal panel. Blue pixel voltage generation unit 24 comprises blue pixel voltage generation sub units 24*a*, 24*b*, . . . , 24*n*, each of which generates a blue pixel driving voltage corresponding to Gamma reference voltage according to its set position so as to drive the blue pixel on the liquid crystal panel.

When the embodiment of the present invention functions, Gamma reference voltage of the voltage input module 1 is applied on the resistor-chain 21, and a plurality of red pixel voltage generation sub units, green pixel voltage generation sub units and blue pixel voltage generation sub units that are set on the resistor-chain 21 sequentially generate corresponding pixel driving voltage. After multi-selector 25 has received the color of pixel being driven, it selects voltage generation unit of the corresponding color (e.g. red pixel voltage generation unit 22) firstly according to the color of pixel being driven, then selects the red pixel voltage generation sub unit corresponding to Gamma reference voltage (for example, red pixel voltage generation sub unit 22*a*) from red pixel voltage generation unit 22 according to Gamma reference voltage. Finally, the red pixel driving voltage of red pixel voltage generation sub unit 22*a* is transmitted to liquid crystal panel through voltage output module 3.

Figure 3:
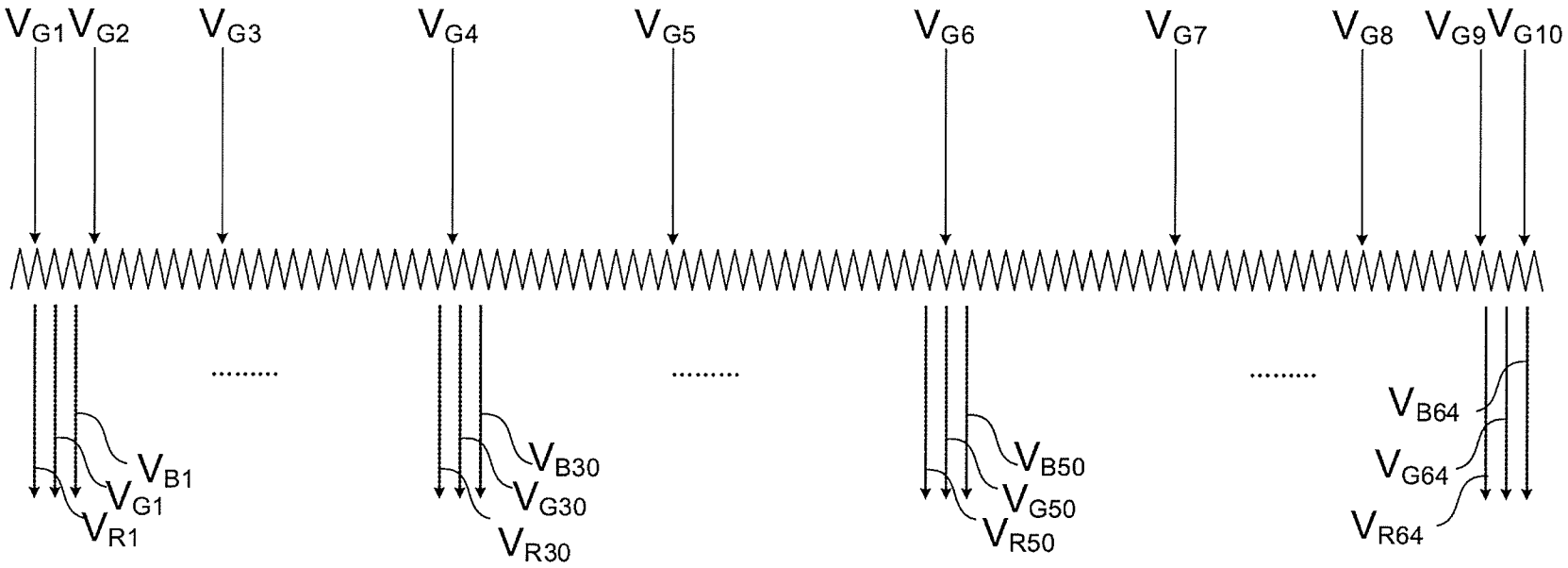
FIG. 3 is a schematic diagram of one implementation structure of the voltage generation module according to an embodiment of the present invention.

FIG. 3 is a schematic diagram of one implementation structure of the voltage generation module according to an embodiment of the present invention. Since each pixel comprises red pixel R, green pixel G and blue pixel B, when it is desired to provide 64 gray levels, the present implementation structure divides 192 output terminals on one resistor-chain with each of 64 gray levels corresponding to 3 output terminals, for example, a first gray level is red pixel output terminal $V_{R1}$, green pixel output terminal $V_{G1}$ and blue pixel output terminal $V_{B1}$; in other words, each color corresponds to 64 output terminals, for example, red color corresponds to first gray level output terminal $V_{R1}$, second gray level output terminal $V_{R2}$, . . . , and 64th gray level output terminal $V_{R64}$. The input terminal of resistor-chain is Gamma reference voltage, the number of which is generally 10 to 18 (10 in the present embodiment), that is, first Gamma reference voltage input terminal $V_{G1}$, second Gamma reference voltage input terminal $V_{G2}$, . . . , and tenth Gamma reference voltage input terminal $V_{G10}$. Practically pixel driving voltage is distinguished into positive and negative polarities, and this embodiment only illustrates the case of one polarity in the pixel driving voltage.

Above technical solution according to the embodiment of the present invention provides a device for driving LCD, in which voltage generation units that respectively generate pixel driving voltages of three colors are set on one resistor-chain, and a corresponding voltage generation unit is selected by multi-selector according to the color of pixel being driven, so that the corresponding voltage generation unit transmits the pixel driving voltage to voltage output module. As compared with Accurate Color Capture solution according to the prior art, the adjusting accuracy of the present invention is higher. As compared with three resistor-chains solution according to the prior art, the present design structure is more simple and manufacture cost is lower. The device for driving LCD according to the present invention effectively overcomes color shifting phenomenon, thus improving TFT-LCD's picture quality.

Figure 4:
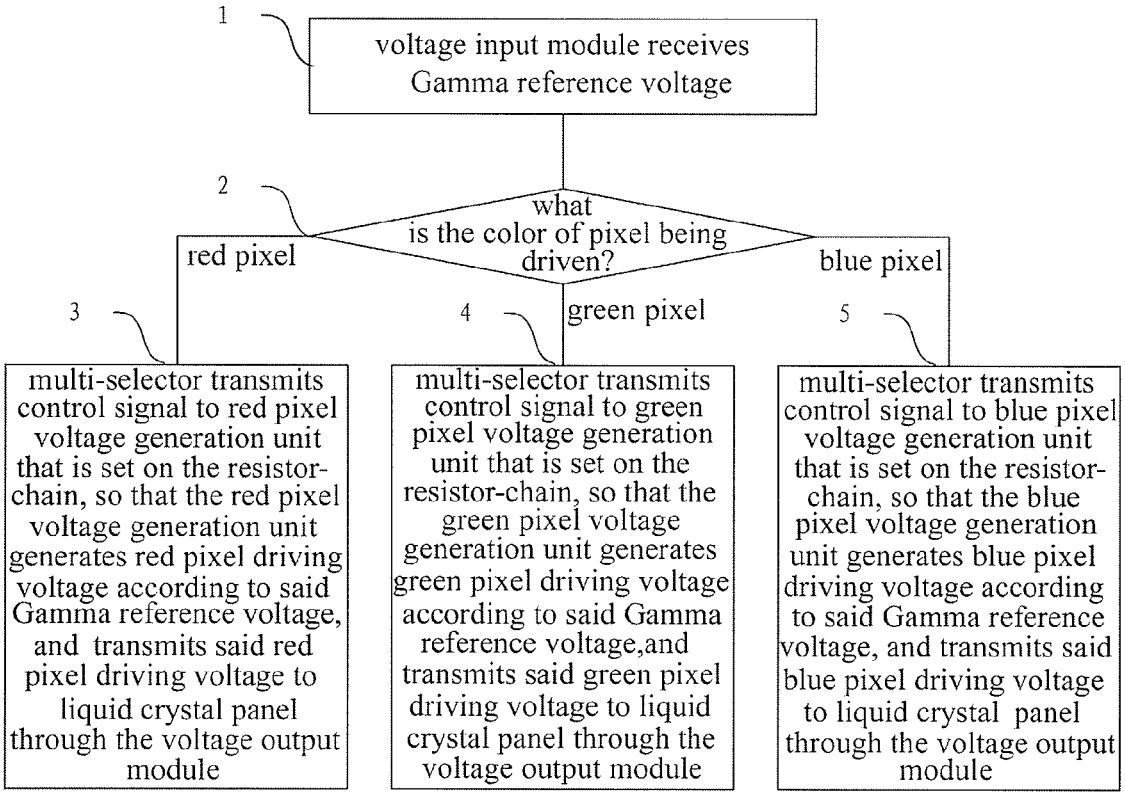
FIG. 4 is a flowchart of the method for driving LCD according to an embodiment of the present invention.

FIG. 4 is a flowchart of the method for driving LCD according to an embodiment of the present invention, details of which are as follows:

step 1: the voltage input module receives Gamma reference voltage;

step 2: the multi-selector receives the color of pixel being driven, and performs step 3 on red pixel, step 4 on green pixel and step 5 on blue pixel according to the color of pixel being driven;

step 3: the multi-selector transmits control signal to red pixel voltage generation unit that is set on the resistor-chain, so that the red pixel voltage generation unit generates red pixel driving voltage according to said Gamma reference voltage, and transmits said red pixel driving voltage to liquid crystal panel through the voltage output module;

step 4: the multi-selector transmits control signal to green pixel voltage generation unit that is set on the resistor-chain, so that the green pixel voltage generation unit generates green pixel driving voltage according to said Gamma reference voltage, and transmits said green pixel driving voltage to liquid crystal panel through the voltage output module;

step 5: the multi-selector transmits control signal to blue pixel voltage generation unit that is set on the resistor-chain, so that the blue pixel voltage generation unit generates blue pixel driving voltage according to said Gamma reference voltage, and transmits said blue pixel driving voltage to liquid crystal panel through the voltage output module.

Figure 5:
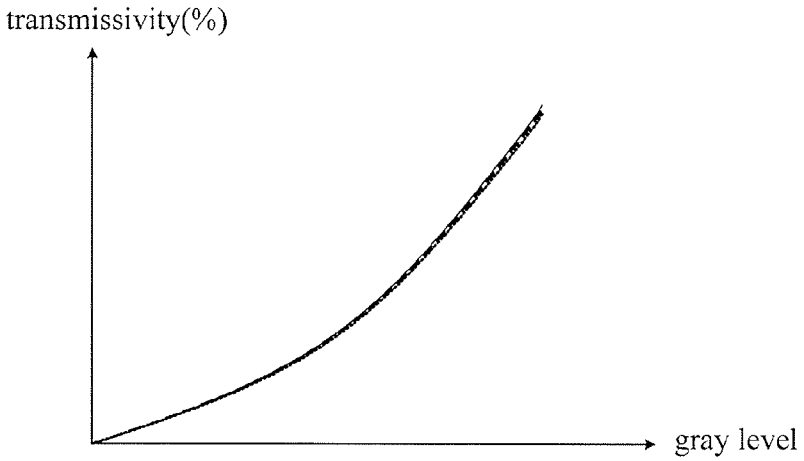
FIG. 5 is a schematic diagram of pixel driving voltage output according to an embodiment of the present invention.
Figure 6:
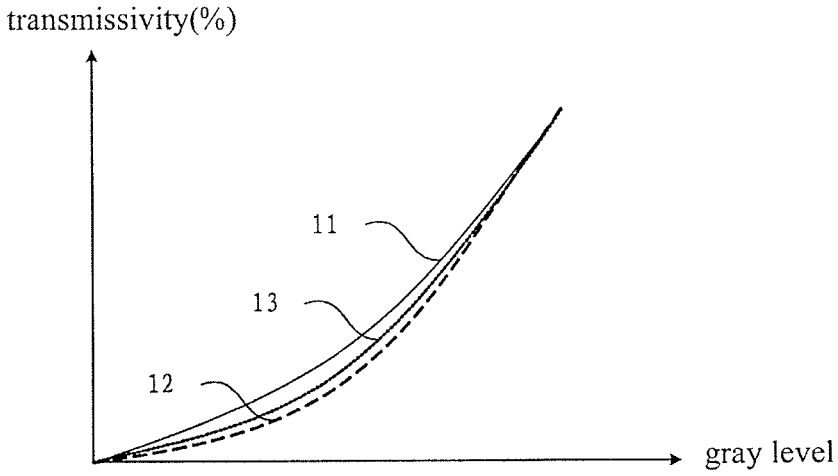
(PRIOR ART) FIG. 6
FIG. 6 is a schematic diagram for illustrating generation of color shifting according to the prior art.
Figure 7:
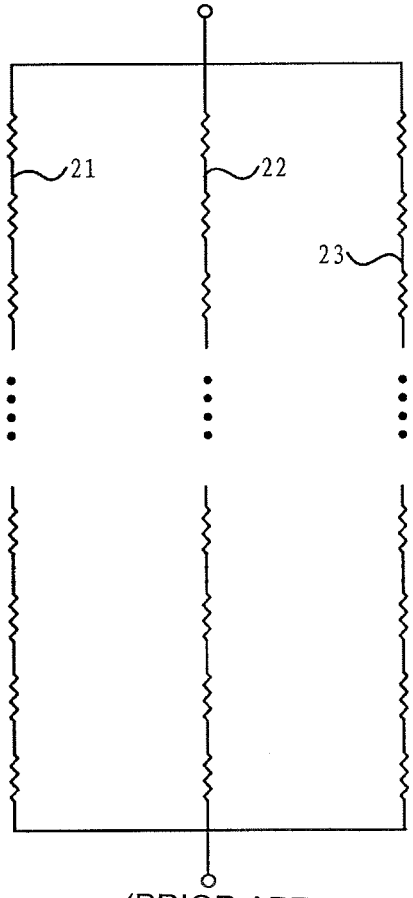
(PRIOR ART) FIG. 7
FIG. 7 is a structural schematic diagram of solution for employing three resistor-chains according to the prior art.

The process flow of the embodiment of the present invention has been described above in details and will not be iterated. FIG. 5 is a schematic diagram of pixel driving voltage output according to an embodiment of the present invention, where ordinate represents transmissivity and abscissa represents gray level. As can be seen from FIG. 5, when using different Gamma voltage with respect to different colors, for the same gray level, transmissivity of the red light represented by solid line, transmissivity of the blue light represented by chain line and transmissivity of the green light represented by broken line are substantially identical, thus color shifting phenomenon is effectively overcome and picture quality is improved.

In the method for driving LCD according to an embodiment of the present invention used with the device for driving LCD according to an embodiment of the present invention, in which voltage generation units that respectively generate pixel driving voltages of three colors are set on one resistor-chain, and a corresponding voltage generation unit is selected by multi-selector according to the color of pixel being driven, so that the corresponding voltage generation unit transmits the pixel driving voltage to voltage output module. As compared with Accurate Color Capture solution according to the prior art, the adjusting accuracy of the present invention is higher. As compared with three resistor-chains solution according to the prior art, the present design structure is more simple and manufacture cost is lower.

Finally, it should be noted that the above embodiments is only for explaining the technical solutions of the embodiments of the present invention, and not for limitation. Although the embodiments of the present invention has been described in details with reference to the embodiments mentioned above, those skilled in the art should be appreciated that the technical solution described in respective embodiments above still can be modified, or part of technical features therein can be equivalently replaced; and these modifications or replacements will not make the essential of corresponding technical solution depart from the spirit and scope of the technical solution in respective embodiments of the present invention.

What is claimed is:

1. A device for driving liquid crystal display, comprising:

a voltage input module for receiving a plurality of gamma reference voltages to be used for all three color components;

a voltage generation module connected to said voltage input module, for generating pixel driving voltage of a corresponding color with one resistor-chain to which the plurality of gamma reference voltages are applied for all three color components, according to the gamma reference voltage and the color of pixel being driven; and a voltage output module connected to said voltage generation module, for transmitting the pixel driving voltage of said corresponding color to a liquid crystal panel;

wherein a plurality of voltage generation units that respectively generate pixel driving voltages for each of three colors are set on said one resistor-chain, and a corresponding voltage generation unit is selected by a multi-selector according to the color of pixel being driven;

said one resistor-chain comprises a plurality of input terminals and a plurality of output terminals, wherein the plurality of input terminals receives the plurality of gamma reference voltages to be used simultaneously for red, green, and blue color components, the plurality of output terminals are divided into a plurality of groups; each group comprises three output terminals for outputting a pixel driving voltage for red color, a pixel driving voltage for green color and a pixel driving voltage from blue color respectively at a same time, and each group corresponds to each of different gray levels respectively.

2. The device for driving liquid crystal display according to claim 1, said voltage generation module comprises:

said one resistor-chain comprising a plurality of resistors in series, input terminal of which is connected to said voltage input module;

a red pixel voltage generation unit set on said one resistor-chain, for generating red pixel driving voltage according to the plurality of gamma reference voltages;

a green pixel voltage generation unit set on said one resistor-chain, for generating green pixel driving voltage according to the plurality of gamma reference voltages;

a blue pixel voltage generation unit set on said one resistor-chain, for generating blue pixel driving voltage according to the plurality of gamma reference voltages;

the multi-selector, input terminal of which receives the color of pixel being driven, and output terminal of which is connected to said red pixel voltage generation unit, said green pixel voltage generation unit and said blue pixel voltage generation unit respectively, for selecting the corresponding red pixel voltage generation unit, green pixel voltage generation unit or blue pixel voltage generation unit according to the color of pixel being driven, so that the corresponding voltage generation unit transmits pixel driving voltage of the corresponding color to a liquid crystal panel through said voltage output module.

3. The device for driving liquid crystal display according to claim 2, said red pixel voltage generation unit comprises a plurality of red pixel voltage generation sub units each generating a red pixel driving voltage corresponding to the plurality of gamma reference voltages.

4. The device for driving liquid crystal display according to claim 2, said green pixel voltage generation unit comprises a plurality of green pixel voltage generation sub units each generating a green pixel driving voltage corresponding to the plurality of gamma reference voltages.

5. The device for driving liquid crystal display according to claim 2, said blue pixel voltage generation unit comprises a plurality of blue pixel voltage generation sub units each generating a blue pixel driving voltage corresponding to the plurality of gamma reference voltages.

* * * * *